US007815445B2

(12) United States Patent
Wu et al.

(10) Patent No.: US 7,815,445 B2
(45) Date of Patent: Oct. 19, 2010

(54) HIGH-SPEED CABLE ASSEMBLY WITH PROTECTIVE MEMBER

(75) Inventors: Jerry Wu, Irvine, CA (US); An-Jen Yang, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 161 days.

(21) Appl. No.: 12/218,852

(22) Filed: Jul. 18, 2008

(65) Prior Publication Data

US 2010/0015846 A1 Jan. 21, 2010

(51) Int. Cl.
*H01R 13/648* (2006.01)

(52) U.S. Cl. ..... 439/99; 439/465

(58) Field of Classification Search ..... 439/98, 439/99, 460, 464, 465, 466, 467
See application file for complete search history.

(56) References Cited

U.S. PATENT DOCUMENTS

| | | | | |
|---|---|---|---|---|
| 5,994,646 | A * | 11/1999 | Broeksteeg et al. | 174/74 R |
| 7,214,097 | B1 | 5/2007 | Hsu et al. | |
| 7,226,316 | B2 | 6/2007 | Wu | |
| 2007/0161281 | A1 * | 7/2007 | Wu | 439/352 |

* cited by examiner

*Primary Examiner*—Ross N Gushi
(74) *Attorney, Agent, or Firm*—Wei Te Chung; Andrew C. Cheng; Ming Chieh Chang

(57) ABSTRACT

A cable assembly (1000) includes an elongated metallic housing (10A) and a cable holder member (6) attached to a rear portion of the housing (10A); a cable (4) coupled to the housing, with a mounting portion (40) thereof gripped by the cable holder member; and a protective member (5) embedded in the mounting portion of the cable, disposed outside of the wires (42) of the cable.

18 Claims, 5 Drawing Sheets

HIGH-SPEED CABLE ASSEMBLY WITH PROTECTIVE MEMBER

FIELD OF THE INVENTION

The present invention generally relates to a high-speed cable assembly, and more particularly to a high-speed cable assembly with protective member for preventing delicate inner structure of the cable being destroyed.

DESCRIPTION OF PRIOR ART

A cable assembly used for high-speed transmission usually includes a connector shielded by an anti-EMI structure and a cable with special configuration controlling impedance thereof along whole transmission line.

For example, U.S. Pat. No. 7,226,316 issued to Wu on Jun. 5, 2007, discloses a cable connector assembly for high-speed signal transmitting. The cable connector assembly includes a metal housing defining a receiving space, a printed circuit board retained in the receiving space, at least one cable electrically connecting with the printed circuit board, a latch mechanism assembled to the metal housing and a holder. The metal housing includes a base and a cover cooperating the receiving space. Both the base and the cover have a back wall having an opening therein, and corresponding cable holder is arranged in the opening for gripping the cable to securely retain the cable with the metal housing. However, an interior structure of the cable may be destroyed as teeth on the cable holder may bite into the cable, and an impedance of the cable may be changed, which might further effect an electrical property of cable connector.

Hence, an improved cable assembly is highly desired to overcome the aforementioned problems.

SUMMARY OF THE INVENTION

Accordingly, an object of the present invention is to provide a cable assembly having a protective member for preventing an inner structure of the cable being destroyed.

In order to achieve the object set forth, a cable assembly in accordance with the present invention comprises a connector having an elongated metallic housing and a cable holder member attached to a rear portion of the housing; a cable coupled to the housing, with a mounting portion thereof gripped by the cable holder member; and a protective member embedded in the mounting portion of the cable, disposed outside of the wires of the cable.

Other objects, advantages and novel features of the invention will become more apparent from the following detailed description when taken in conjunction with the accompanying drawings.

DETAILED DESCRIPTION OF PREFERRED EMBODIMENTS

Reference will now be made in detail to the preferred embodiment of the present invention.

Figure 1:
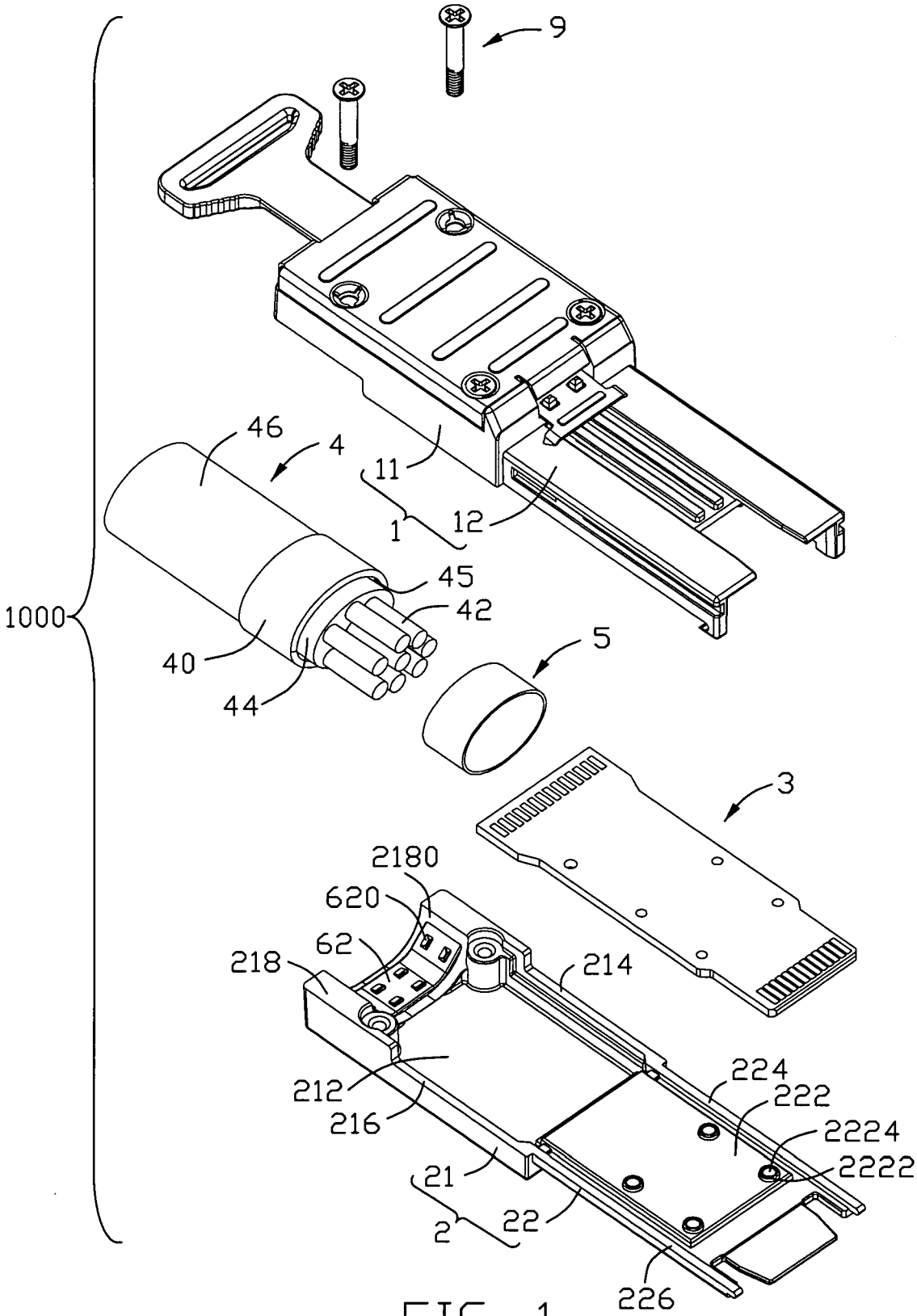
FIG. 1 is an exploded, perspective view of a cable assembly in accordance with the present invention.
Figure 2:
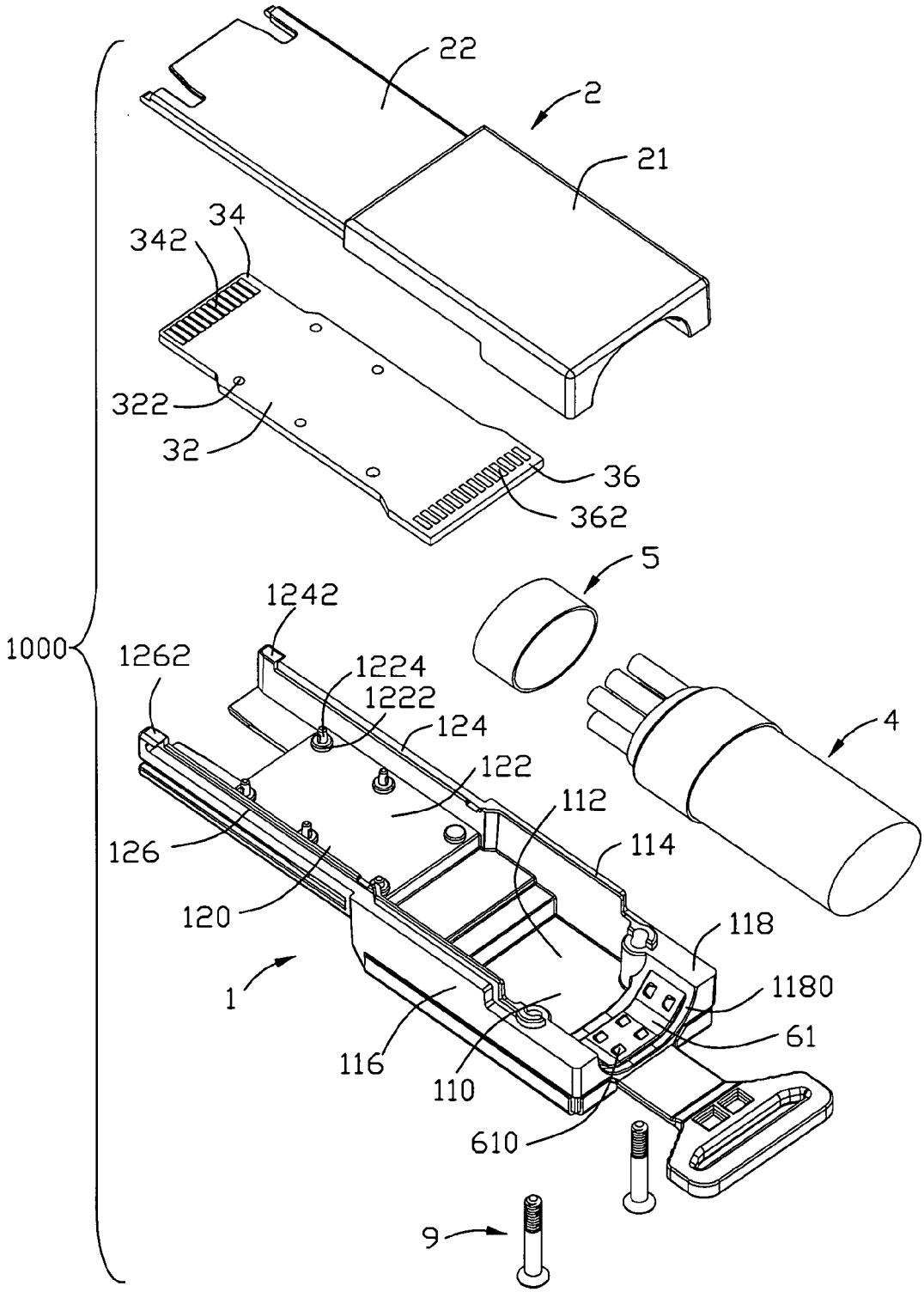
FIG. 2 is similar to FIG. 1, but viewed from another aspect.
Figure 3:
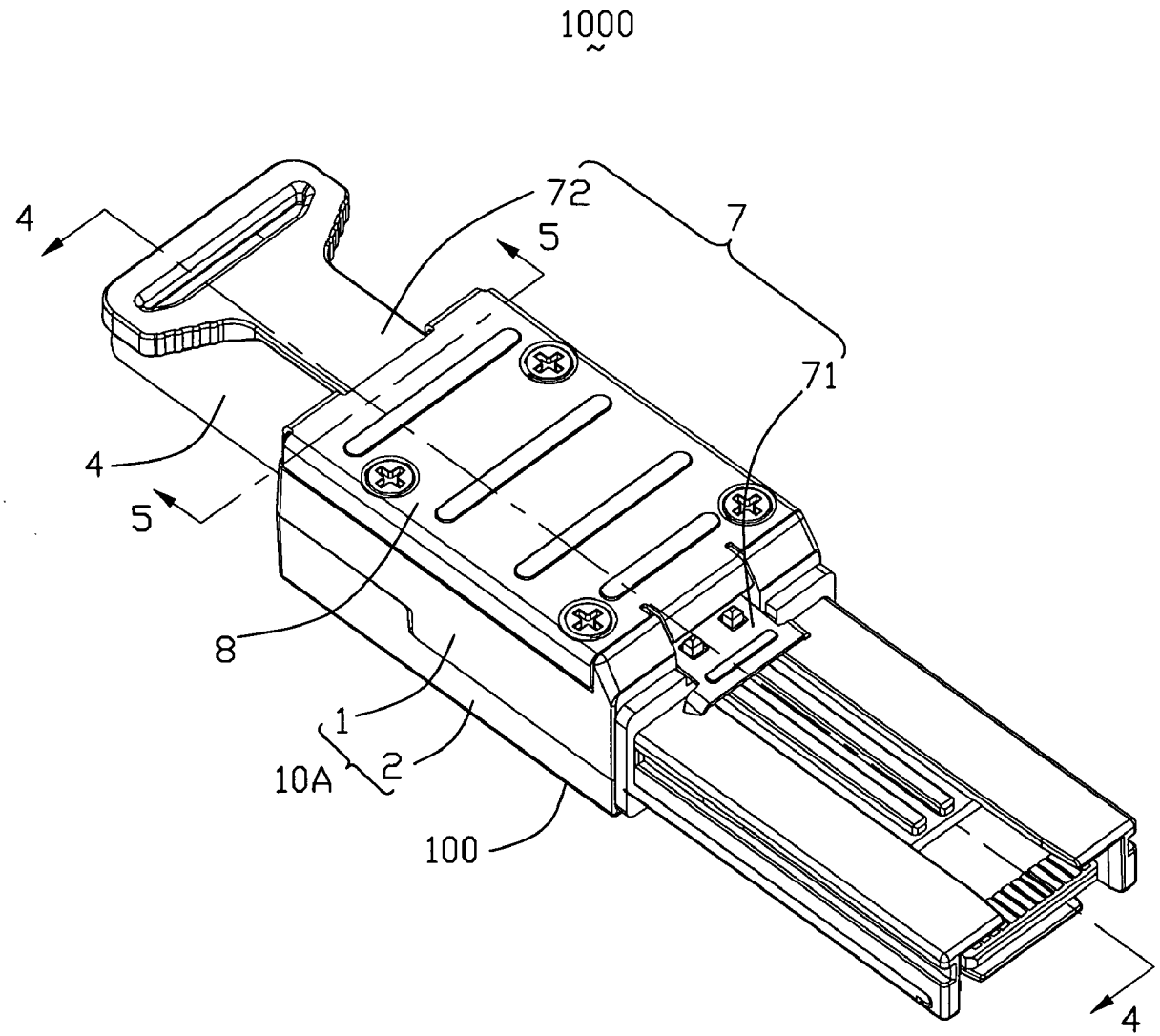
FIG. 3 is an assembled, perspective view of the cable assembly.
Figure 4:
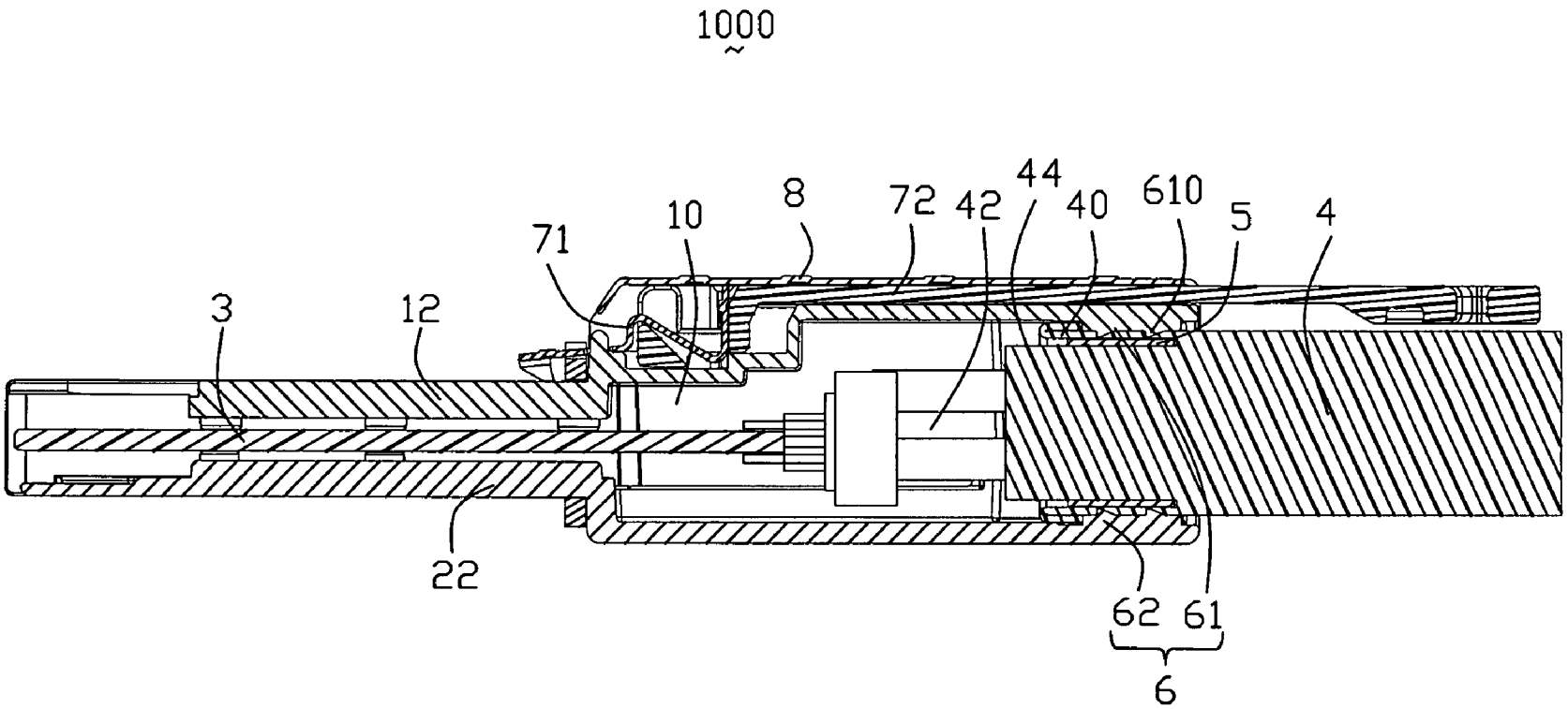
FIG. 4 is a cross-section view taken along line 4-4 of FIG. 3.
Figure 5:
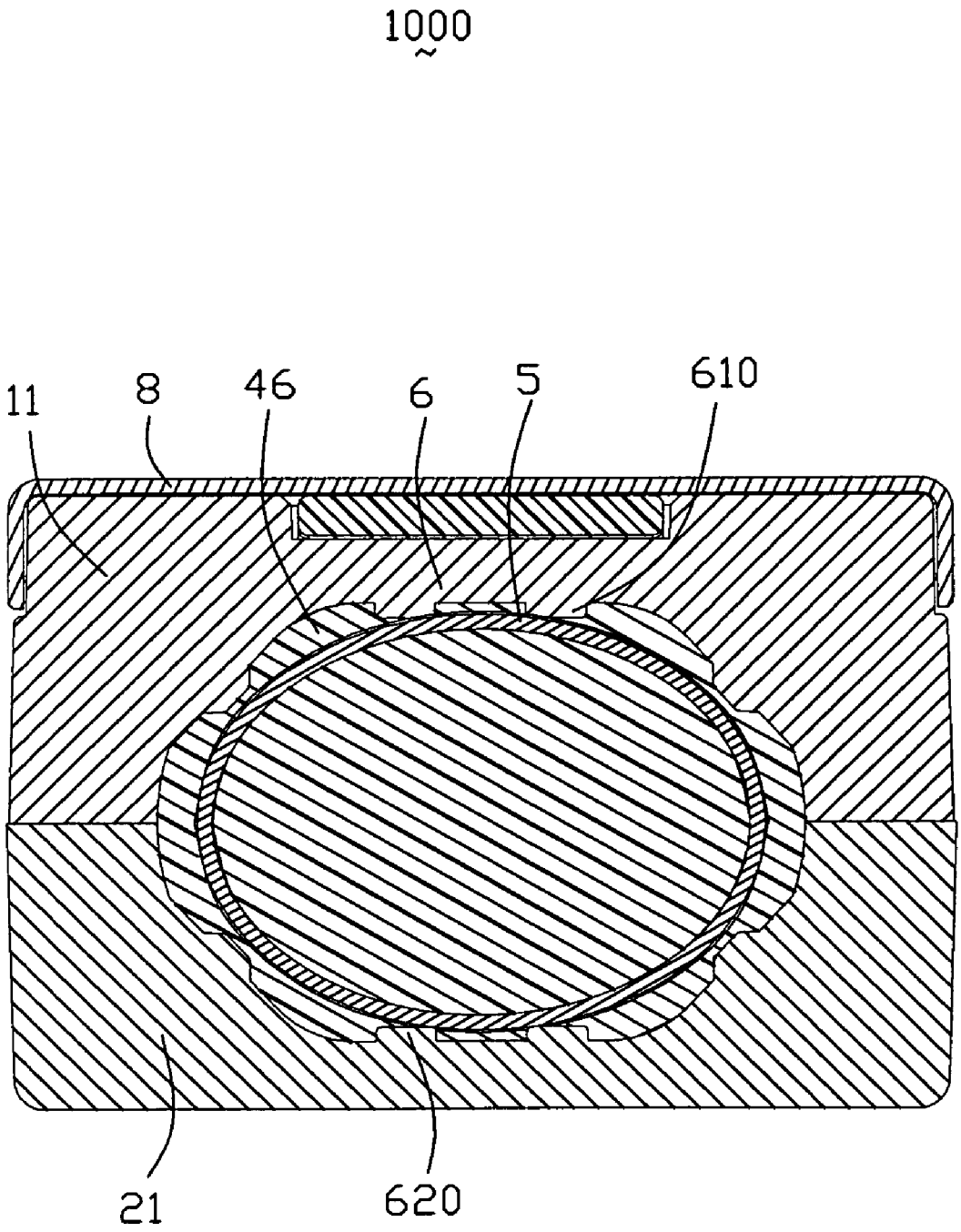
FIG. 5 is a cross-section view taken along line 5-5 of FIG. 3.

Referring to FIGS. 1-5, a cable assembly 1000 in accordance with the present invention comprises a connector 100 and a cable 4 connected thereto. The connector 100 has an elongated metallic housing 10A having an upper first shield part 1 and a lower second shield part 2 together enclosing a receiving space 10 therein, a printed circuit boards (PCB) 3 accommodated in the receiving space 10, a protective member 5 embedded in a front portion of the cable 4 and a cable holder member 6 attached the front portion of the cable 4.

The first shield part 1 comprises an expanded first base portion 11 and a relative slim first mating portion 12 extending forwardly from a front edge of the first base portion 11. The first base portion 11 has a top wall 112, a pair of side walls 114, 116 and a rear wall 118 together forming a hollow portion 110. A first semi-circular shape cavity 1180 are defined in a rear wall 118 and further communicated with the hollow portion 110. The first mating portion 12 has a top wall 122, a pair of transversal walls 124, 126 forming a mating port 120 located in front of and communicating with the hollow portion 110. Two pair of position posts 1222 are spaced apart each other and arranged at lateral sides of the top wall 122 and each of them further has a tiny stub 1224 formed thereon.

The second shield part 2 comprises a second base portion 21 and a second mating portion 22 extending forwardly from a front edge of the second base portion 21. The second base portion 21 has a bottom wall 212, a pair of side walls 214, 216 and a rear wall 218 extending upwardly from lateral edges and rear edge of the bottom wall 212. A second semi-circular shape cavity 2180 are defined in a rear wall 118. The second mating portion 22 has a bottom wall 222, a pair of transversal flanges 224, 226 located at lateral sides of the bottom wall 222. Two pair of supporting members 2222 are spaced apart each other and arranged at lateral sides of the bottom wall 222. Each of the supporting members 2222 further has a hole 2224 aligning with corresponding tiny stub 1224 of the position post 1222.

The PCB 3 includes middle portion 32, narrower front portion 34 and broader rear portion 36. A group of first conductive pads (or contacts) 342 arranged on the front portion 34 to form a mating interface and a set of second conductive pads 362 arranged on the rear portion 36 to from a connecting portion.

The cable 4 includes a number of wires 42, a shielding portion 44 enclosing the wires 42, a jacket 46 enclosing the shielding portion 44. The shielding portion 44 may be an aluminum foil or other similar thin structure made of soft conductive/metallic materials. The jacket 46 includes an outer insulative layer and inner metallic braiding portion combined together. Such structure may endure greater pull force and protect wires 42 and delicate shielding portion 44. Partial of jacket 46 and shielding portion 44 of a front free end of the cable 4 are removed, with wires 42 exposed outside and soldered to the mounting portion of the PCB 3.

A certain peripheral portion of a front section of the cable 4 is retained in the cavities 1180, 2180 of the rear walls 118, 218 may be regarded as a mounting portion 40.

A circular-shaped hollow portion 45 is formed between the jacket 46 and the shielding portion 44 of the mounting portion 40 and extending along an axial direction of the cable 4.

The protective member 5 is ring-shaped and has a certain length substantially equal to that of the cable holder member 6 along the axial direction. The protective member inserted to the hollow portion 45 of the cable 4 and mounted to the outside of the shielding portion 44. However, the protective member 5 may be other shape, in accordance with an outer shape of the cable. The protective member 5 is made of metallic materials or other hard and rigid materials which can supply sufficient precaution for the shielding portion 44.

The cable holder member 6 includes a first half 61 and a second half 62 respectively disposed/retained in the first and second cavities 1180, 2180 in the rear walls 118, 218 of the metallic housing 10. Some teeth or staples 610, 620 are formed on inner sides of the first and second halves 61, 62 of the cable holder members 6. However, it should be noticed that cable holder member 6 may be of one-piece ring-shaped structure. In alternative embodiment, the cable holder member may be cavities or opening in the rear wall of the metallic housing with a relative smaller dimension than that of the cable 4, so as to sandwich or hold the cable 4 therethrough. Furthermore, the cable holder member may be a holding portion at an end of a metal housing, which is introduce in U.S. Pat. No. 7,214,097, issued to Hsu on May 8, 2007. In a word, the term "cable holder member" herein refers to any structure that is used for holding, sandwiching, gripping the mounting portion of the cable, so as to make the cable and connector combined together securely.

When assembly, the wires 42 are soldered to the connecting portion of the PCB 3. Then the PCB 3 is mounted to the first shield part 1 and supported by the pair of position posts 1222, with the tiny stubs 1224 passing through holes 322 defined in the middle portions 32 of the PCB 3, the mating interface extending into the mating port 120 and the mounting portion located in the hollow portion 110; the mounting portion 40 of the cable 4 is disposed inside of the first half 61 of the cable holder member 6. Secondly, the second shield part 2 is assembled to the first shield part 1, with hook portions 1242, 1262 formed at front end portions of the pair of transversal walls 124, 126 engaging with front end portions of the transversal flanges 224, 226, distal ends of the tiny stubs 1224 inserted into holes 2224 of the supporting members 2222 to position the PCB 3. Thirdly, screws 9 are utilized to fasten the first and second shield parts 1, 2 together securely. The mounting portion 40 of the cable 4 is tightly gripped by the cable hole 6, with teeth 610, 620 biting into the jacket 46 of the cable 4. The protective member 5 arranged inside of the mounting portion 40 prevents the teeth 610, 620 penetrating the shielding portion 44 of the cable 4. Thus, the shielding portion 44 and wires 42 inside of the cable 4 is not deformed or destroyed, and impedance of the cable 4 is not changed.

An optional latch mechanism 7 is assembled to the housing 10A of the cable assembly 1000. The latch mechanism 7 includes a latch member 71 and a pull member 72 for actuating the latch member 71. The latch member 71 and the pull member 72 is mounted to the first shield part 1 of the metallic housing 10A and partially shielded by a cap member 8.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

The invention claimed is:

1. A cable assembly, comprising:

a connector having an elongated metallic housing and a cable holder member attached to a rear portion of the housing;

a cable coupled to the housing, with a mounting portion thereof gripped by the cable holder member; and a protective member embedded in the mounting portion of the cable, disposed outside of the wires of the cable;

wherein the cable has a shielding portion enclosing the wires and a jacket enclosing the shielding portion;

wherein the protective member is disposed between the shielding portion and the jacket.

2. The cable assembly as recited in claim 1, wherein the protective member is a ring-shaped metallic member enclosing outside of the wires.

3. The cable assembly as recited in claim 2, wherein the protective member has a length substantially equal to that of the cable holder member along an axial direction of the cable.

4. The cable assembly as recited in claim 1, wherein the cable holder member has a number of teeth formed on an inner side thereof and biting into the jacket.

5. The cable assembly as recited in claim 1, wherein the housing includes a first shield part and a second shield part combined together to define a receiving space.

6. The cable assembly as recited in claim 1, wherein a printed circuit board retained with the first and second shield part.

7. The cable assembly as recited in claim 6, wherein the printed circuit board has a mating interface located in a mating port arranged in the front of the receiving space and a connecting portion disposed in a hollow portion at back of the receiving space, and wherein the wires are soldered to the connecting portion of the printed circuit board.

8. A cable assembly, comprising:

a cable defining a mounting portion in a front section thereof, with a hollow portion arranged inside of the mounting portion and encircling outside of wires of the cable;

a protective member assembled to the hollow portion of the mounting portion; and a housing including a first shield part and a second shield part together forming a receiving space, both the first and second shield part defining a cavity communicated with the receiving space, said cable extending into the receiving space via the cavities, with mounting portion thereof retained in the cavities of the first and second shielding part;

wherein an aluminum foil encloses the wires of the cable, with the protective member assembled thereto.

9. The cable assembly as recited in claim 8, wherein a cable holder member is located in the cavities of the first and second shield part to sandwich the mounting portion of the cable.

10. The cable assembly as recited in claim 9, wherein a number of staples are formed on an inner surface of the cable holder member and penetrated into the mounting portion of the cable.

11. The cable assembly as recited in claim 8, wherein a printed circuit board is accommodated in the receiving space and engages with the housing.

12. The cable assembly as recited in claim 8, wherein the first and second shield part are die-cast members.

13. The cable assembly as recited in claim 8, wherein two hook portions formed at front end portions of the first shield part engage with front end portions of the second shield part.

14. The cable connector assembly comprising:

an outer housing enclosing an insulative inner housing therein with a mating port locate around a front end of the outer housing; and a cable having a front end around a rear end of the outer housing where a cable holder member with teeth thereon is located, said cable including a jacket defining at least an outer insulative layer and enclosing a shielding portion which encloses a plurality of wires;

wherein a reinforcement protective member encloses a front portion of the shielding portion and cooperates with the cable holder member to raidially sandwich a front portion of the outer insulative layer of the jacket therebetween.

15. The cable connector assembly as claimed in claim 14, wherein said protective member own sufficient strength thereof so as to cooperate with the holder member to tightly sandwich the front portion of the outer layer of the jacket therebetween for retention.

16. The cable connector assembly as claimed in claim 14, wherein all the outer housing, the cable holder member and the reinforcement member are all metallic.

17. The cable connector assembly as claimed in claim 14, wherein said shielding portion includes an aluminum foil where the reinforcement protective member is assembled thereto.

18. The cable connector assembly as claimed in claim 14, wherein said jacket is further equipped with an inner metallic braiding portion thereof under said outer insulative layer.

* * * * *